US008091368B2

(12) United States Patent
Cayre et al.

(10) Patent No.: US 8,091,368 B2
(45) Date of Patent: Jan. 10, 2012

(54) TURBOMACHINE COMBUSTION CHAMBER

(75) Inventors: Alain Cayre, Pamfou (FR); Denis Jean Maurice Sandelis, Nangis (FR)

(73) Assignee: SNECMA, Paris (FR)

( * ) Notice: Subject to any disclaimer, the term of this patent is extended or adjusted under 35 U.S.C. 154(b) by 500 days.

(21) Appl. No.: 12/333,930

(22) Filed: Dec. 12, 2008

(65) Prior Publication Data

US 2009/0151359 A1 Jun. 18, 2009

(30) Foreign Application Priority Data

Dec. 14, 2007 (FR) ..... 07 08766

(51) Int. Cl.
*F02C 1/00* (2006.01)

(52) U.S. Cl. ..... 60/756; 60/752

(58) Field of Classification Search ..... 60/737, 60/740, 748, 752, 754, 755–757
See application file for complete search history.

(56) References Cited

U.S. PATENT DOCUMENTS

| | | | | |
|---|---|---|---|---|
| 3,916,619 | A * | 11/1975 | Masai et al. | 60/756 |
| 4,085,581 | A * | 4/1978 | Caruel et al. | 60/738 |
| 4,313,721 | A * | 2/1982 | Henriques | 431/265 |
| 5,435,139 | A | 7/1995 | Pidcock et al. | |
| 5,941,076 | A | 8/1999 | Sandelis | |
| 5,956,955 | A * | 9/1999 | Schmid | 60/748 |
| 6,546,733 | B2 * | 4/2003 | North et al. | 60/772 |

FOREIGN PATENT DOCUMENTS

EP 0 821 201 1/1998

* cited by examiner

*Primary Examiner* — Ehud Gartenberg
*Assistant Examiner* — Phutthiwat Wongwian
(74) *Attorney, Agent, or Firm* — Oblon, Spivak, McClelland, Maier & Neustadt, L.L.P.

(57) ABSTRACT

A turbomachine combustion chamber including a chamber bottom with at least one opening designed to receive a combustion bowl in the axis of which an air and fuel injection device is mounted is disclosed. The downstream end of the flared bowl includes a divergent with a double partition delimiting an annular cavity. The first outer partition includes inlet orifices arranged to cool the second inner partition by impact and the second inner partition includes outlet orifices. The inlet orifices, distributed in at least two circular rows on the periphery of the divergent, are in staggered rows with the outlet orifices.

8 Claims, 3 Drawing Sheets

TURBOMACHINE COMBUSTION CHAMBER

The present invention relates to the field of combustion chambers of aviation turbomachines.

BACKGROUND OF THE INVENTION

It relates more precisely to a turbomachine combustion chamber comprising a chamber bottom which has at least one opening designed to receive a bowl in the axis of which an air and fuel injection device is mounted, said bowl being flared in the direction of flow of the gases and comprising cooling means. The bowl 30 comprises a concentric cylindrical portion and a frustoconical portion, called a divergent. Such a combustion chamber is represented in FIG. 1.

In the combustion chambers of this type, notably the chambers of turbojets for military use, the bowls and the deflectors or cups fitted to the chamber bottoms are under particular stress.

Because of the evolution of turbojets, the chamber is subjected to very considerable heat and mechanical stresses to the chamber-bottom elements, more particularly the combustion bowl and the partition of the downstream collar of the bowl are subjected to high temperatures.

DESCRIPTION OF THE PRIOR ART

Through patent EP0821201B1, it is known practice to cool the divergent of the combustion bowl by convection by causing air to circulate in a cavity formed in the divergent. Flow disrupters are placed in the cavity in order to slow the air flow which is then expelled into the combustion chamber in order to participate in the spraying of the fuel. However, because of the slowing of the air in the cavity, the air flow tends to heat up and does not make it possible to cool the divergent effectively.

Through patent EP0182687B1, it is also known practice to cool a combustion bowl having a double-partition divergent. Since the outer partition of the divergent comprises inlet orifices to cool the downstream partition by impact, the air then escapes via an outlet channel arranged downstream of the divergent and designed to cool the latter by "blowing". Cooling by impact, as is carried out in this instance, does not make it possible to cool the divergent effectively. Since the outlet channel is arranged at a distance from the inlet orifices, the air flow tends to heat up during its passage between the partitions, which adversely affects the cooling of the divergent.

SUMMARY OF THE INVENTION

In order to solve at least certain of these disadvantages, the applicant proposes a combustion chamber allowing an effective cooling of the divergent of the combustion bowl while promoting the spraying of the fuel-air mixture originating from the injector.

For this purpose, the invention relates to a turbomachine combustion chamber comprising a chamber bottom which comprises at least one opening designed to receive a combustion bowl in the axis of which an air and fuel injection device is mounted, said flared bowl comprising downstream a divergent consisting of a double partition delimiting an annular cavity, the first outer partition comprising inlet orifices arranged to cool the second inner partition by impact;

the second inner partition comprising outlet orifices;

a chamber in which the inlet orifices, distributed in at least two circular rows on the periphery of the divergent, are in staggered rows with the outlet orifices.

The inner partition of the divergent is advantageously cooled by impact via the two circular rows of inlet orifices, which makes it possible to guide an air flow over the entire surface of the divergent while allowing an effective circulation of the flow due to the orifices being configured in a staggered manner.

Preferably, the tangential incidence of the outlet orifices is between 20° and 45°.

Again preferably, the tangential incidence of the inlet orifices is equal, and in the same direction, to that of the outlet orifices.

The cooling air, entering the annular cavity through the inlet orifices and leaving through the outlet orifices, is advantageously made to swirl which creates turbulence promoting the spraying and shearing of the fuel-air mixture.

Again preferably, the combustion chamber comprises at least one spiral arranged in order to swirl the air and the fuel injected into the chamber.

Again preferably, the tangential incidence of the plurality of outlet orifices is in the opposite direction to the direction of swirl of the spiral.

Advantageously, the swirling generated by the spiral is disrupted by the swirling, rotated in the reverse direction, generated by the outlet orifices which improves the spraying and shearing of the fuel-air mixture.

Preferably, the outlet orifices and the inlet orifices are distributed in circular rows, the orifices of each row being evenly distributed over the periphery of the bowl.

BRIEF DESCRIPTION OF THE DRAWINGS

The invention will be better understood with the aid of the appended drawings in which.

DESCRIPTION OF THE PREFERRED EMBODIMENTS

Figure 1:
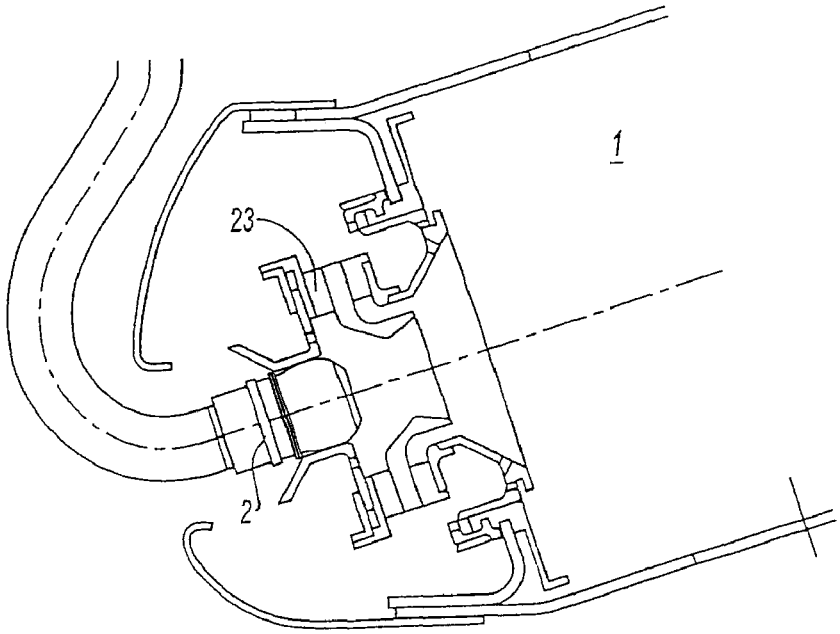
Fig. 1 PRIOR ART
FIG. 1 represents a view in radial section of a combustion chamber bottom according to the prior art.
Figure 2:
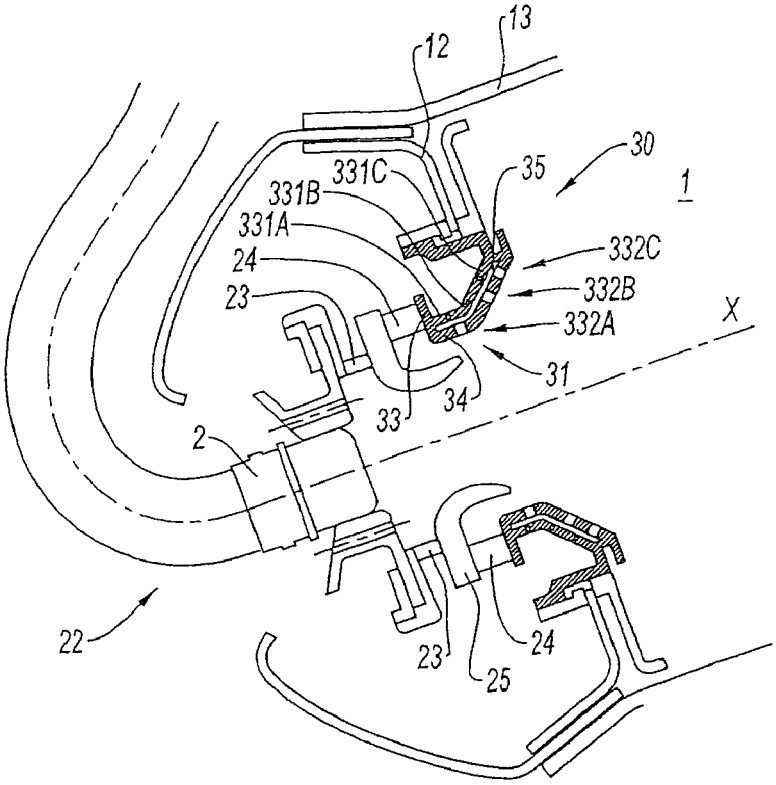
FIG. 2 represents a view in radial section of a combustion chamber bottom with a combustion bowl according to a first embodiment of the invention.

FIG. 2 shows the upstream end of a combustion chamber 1 for a turbojet comprising an air and fuel injection system 22. A fraction of the upstream air originating from the compressor is guided through the injection system 22 for the formation of a fuel-air mixture injected along an axis X; the latter enters the primary zone where the combustion reactions take place, then the gases produced are diluted and cooled in the downstream secondary zone, not shown, and are distributed toward the turbine that they drive.

The injection system 22 comprises a fuel injector 2 with aerodynamic spraying for example as described in patent FR-A-2 206 796.

This injector 2 comprises a profiled central fuel-delivery body extended downstream by swirling fins 23 with radial flow forming an internal centripetal spiral; an annular cap 25 is provided with an inner channel connecting to the inner spiral 23. A row of outer fins 24 forming an outer spiral with substantially radial flow is mounted on this cap 25.

The thin layer of fuel is thus sprayed by shearing effect between the air flow made to swirl by the inner spiral and the air flow made to swirl by the outer spiral.

The injector 2 is connected to the combustion chamber 1 by means of a part of circular section, called a combustion bowl 30, which is, for its part, frustoconical widening out in the downstream direction. The bowl 30 comprises a cylindrial portion concentric with the inner spiral and a frustoconical portion, called a divergent 31, forming with the cap 25 an annular channel for the swirling air flow originating from the outer spiral.

The bowl 30 is connected to the wall 12 of the chamber bottom at its downstream edge, the chamber being delimited by an outer wall 13.

The divergent 31 of the combustion bowl consists of a double partition delimiting an annular cavity 35 with a thickness of between 0.5 and 0.8 mm. This double partition comprises a first outer partition 33 and a second inner partition 34 comprising respectively inlet orifices 331 and outlet orifices 332 for the cooling air flow originating from the compressor.

With reference to FIG. 2, representing a first embodiment of the invention, the inlet orifices 331 form three circular peripheral rows 331A, 331B, 331C in the outer partition 33. The inlet orifices 331 are, for each row, evenly distributed over the periphery of the bowl 30. These inlet orifices 331 are arranged to guide the air flow originating from the compressor and cool the inner partition 34 of the divergent 31 by impact. The jets of cooled air strike the inner partition 34 of the divergent 31 at high speed which makes it possible to lower its temperature and limit the formation of hot spots in the bowl 30.

The outlet orifices 332, in a manner similar to the inlet orifices 331, form three circular peripheral rows 332A, 332B, 332C in the inner partition 34. The outlet orifices 332 are, for each row, evenly distributed over the periphery of the bowl 30. The inlet orifices 331 are in this instance placed in a staggered manner with the outlet orifices 332 as shown in FIG. 3 in order to even out the cooling of the inner partition 34 of the bowl 30.

Figure 3:
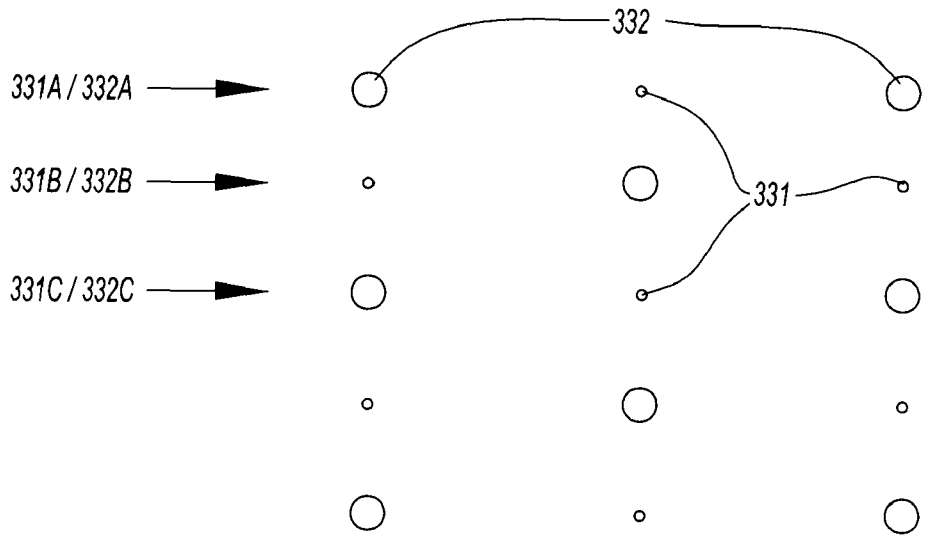
FIG. 3 represents a schematic arrangement of the inlet and outlet orifices arranged in a staggered manner in the partitions of the divergent of the combustion bowl.

With reference more particularly to FIG. 3, the inlet orifices 331 have a small diameter, of between 0.8 mm and 1 mm, in order to increase the speed of the air flow in the annular cavity 35. As an example, the inlet orifice 331 of the row 331C leads to four outlet orifices 332 whose diameter, greater than that of the inlet orifices 331, is between 1.5 mm and 2.5 mm.

When the air circulates in the annular cavity 35, the air flow enters through this inlet orifice 331 of small diameter and escapes rapidly through the four outlet orifices 332 placed in a staggered manner in its vicinity, in order to participate in the spraying of the fuel-air mixture and in the cooling of the walls of the combustion chamber. Therefore, thanks to this staggered arrangement, the air flow travels with a considerable speed in the cavity 35. The air flow does not have the time to heat up which allows an effective cooling of the divergent 31.

With reference to FIG. 2, the row 332C of outlet orifices, placed furthest downstream of the divergent 31, actively participates in the cooling of the walls of the combustion chamber 1, the intermediate row 332B participating in the spraying of the fuel-air mixture and the row 332A of outlet orifices, placed furthest upstream, participating in the shearing of the fuel-air mixture in cooperation with the outer spiral 24 placed in its vicinity.

The inlet orifices 331 have a tangential incidence of between 20° and 45°, which makes it possible to increase the time that the cooling air spends in the annular cavity 35 and to prevent the latter from circulating between the partitions 33, 34 at too high a speed without taking heat from the divergent 31.

In a similar manner, the outlet orifices 332 have a tangential incidence in the same direction and of the same value as the tangential incidence of the inlet orifices 331. Therefore, the cooling air is swirled in the combustion chamber 1 in order to form a spiral air flow making it possible to spray rapidly and effectively the fuel-air mixture and to cool the walls of the combustion chamber 1.

The tangential incidence of the outlet orifices 332 is adapted so as to be in the opposite direction from the orientation of the second outer radial spiral 24. Therefore, in operation, the cooling air flow coming out of the outlet orifices 332 is made to swirl in the rotation direction contrary to that of the outer radial spiral 24. This contra-rotating swirl promotes the shearing and spraying of the fuel-air mixture.

Each row of inlet orifices 331 and outlet orifices 332 comprises the same number of orifices which are placed in a staggered manner relative to one another. It is possible to modify the number of rows of orifices and their positioning on the divergent 31 according to the effect that it is desired to promote (shearing of the layer of fuel, spraying of the fuel-air mixture or cooling of the walls of the combustion chamber).

Figure 4:
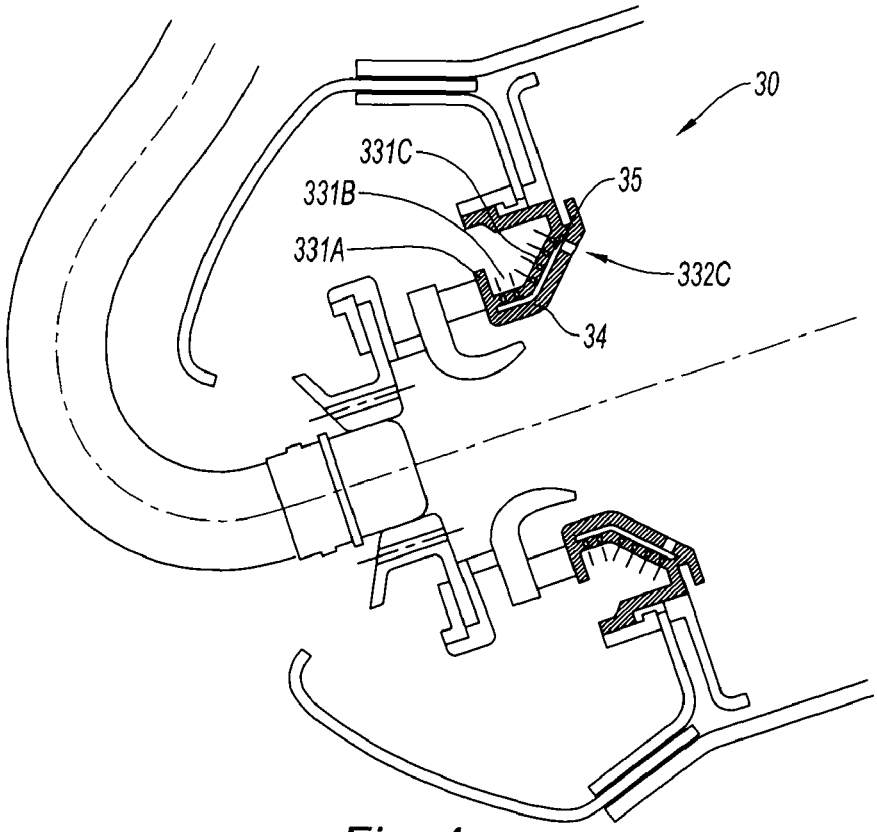
FIG. 4 represents a view in radial section of a combustion chamber bottom with a combustion bowl according to a second embodiment of the invention.

As an example, with reference to a second embodiment, the downstream partition 34, shown in FIG. 4, comprises a single row of outlet orifices 332C whose orifices 332 are placed in a staggered manner with the inlet orifices 331 arranged in the outer partition 33, the inlet orifices 331 being divided into five rows. In this example, the inlet orifices 331 have a smaller diameter and are more numerous in comparison with the first embodiment of FIG. 2, the cooled air flow nevertheless remaining substantially equal.

Still with reference to FIG. 4, the row of outlet orifices 332C is arranged downstream of the inner partition 34 of the divergent 31. After the air flow has cooled by impact the inner partition 34, the latter is guided into the annular cavity 35 before being expelled axially downstream of the divergent 31 in order to participate in the cooling of the walls of the combustion chamber 1, thereby preventing the heat generated by the combustion from causing the creation of hot spots on the walls of the combustion chamber 1.

Figure 5:
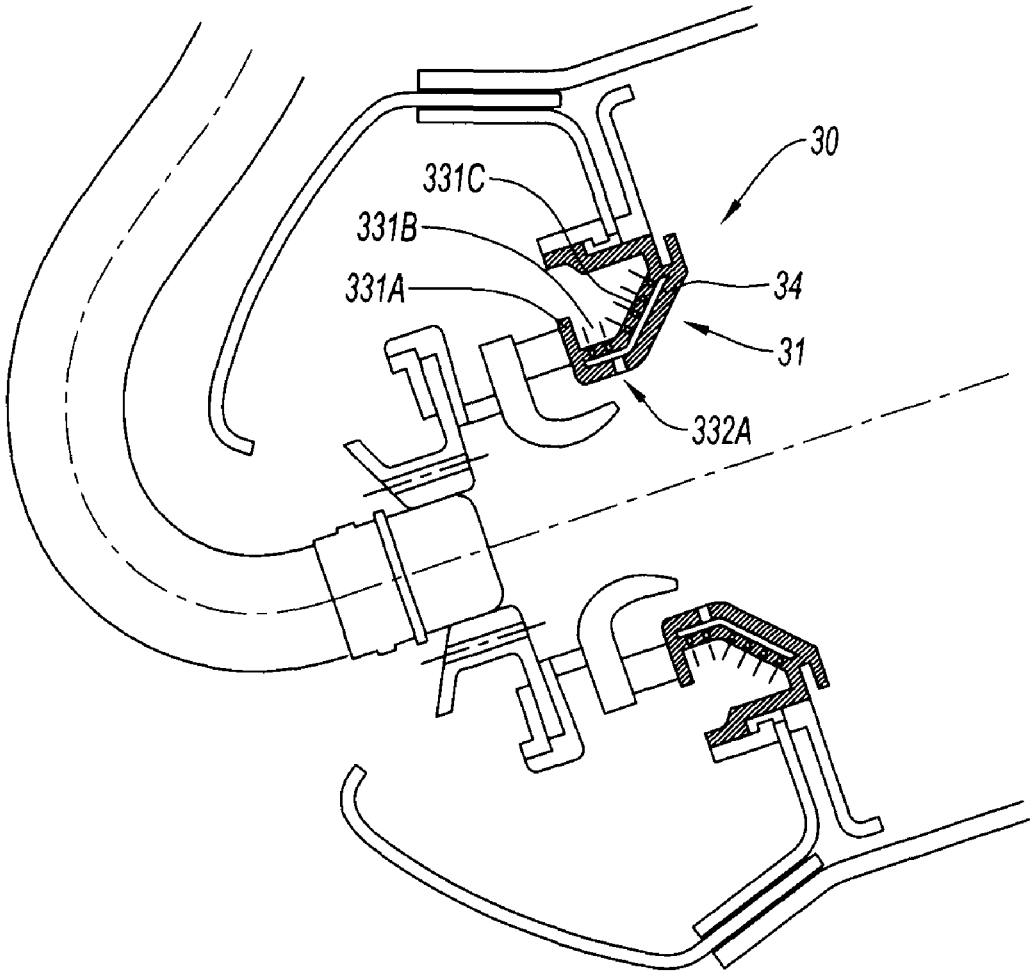
FIG. 5 represents a view in radial section of a combustion chamber bottom with a combustion bowl according to a third embodiment of the invention.

With reference to a third embodiment represented in FIG. 5, the inner partition 34 comprises a single row of outlet orifices 332A whose orifices 332 are placed in a staggered manner with the inlet orifices 331 arranged in the outer partition 33, the inlet orifices 331 being divided into five rows in a manner similar to the second embodiment of the invention.

Still with reference to FIG. 5, the row of outlet orifices 332A is arranged upstream of the inner partition 34 of the divergent 31. After the air flow has cooled by impact the inner partition 34, the row 332A of outlet orifices radially shears the layer of fuel-air mixture in the immediate vicinity of the injector 2. The tangential incidence of the outlet orifices 332 opposite to that of the second outer spiral 24 improves still more the shearing of the layer of fuel-air mixture and allows an even spraying without the creation of hot spots on the divergent 31 of the combustion bowl 30.

What is claimed is:

1. A turbomachine combustion chamber comprising:

a chamber bottom with at least one opening;

a flared combustion bowl which is received in the at least one opening of the chamber bottom, a downstream end of the flared bowl including a divergent;

an air and fuel injection device mounted in the flared bowl along an axis of the flared bowl, wherein the divergent includes a first outer partition and a second inner partition arranged coaxially along the axis of the flared bowl so as to define therebetween an annular cavity, wherein each of the first outer partition and the second inner partition includes an upstream axial portion, a downstream radial portion, and a frustoconical portion connecting the upstream axial portion to the downstream radial portion, wherein the first outer partition includes inlet orifices arranged to cool the second inner partition by impact and the second inner partition includes outlet orifices, and wherein the inlet orifices are distributed in at least two circular rows on a periphery of the divergent and are in staggered rows with the outlet orifices.

2. The combustion chamber as claimed in claim 1, wherein a tangential incidence of the outlet orifices is between 20° and 45°.

3. The combustion chamber as claimed in claim 1, wherein a tangential incidence of the inlet orifices is equal, and in the same direction, to that of the outlet orifices.

4. The combustion chamber as claimed in claim 1, wherein the combustion chamber comprises at least one spiral arranged in order to swirl the air and the fuel injected into the chamber.

5. The combustion chamber as claimed in claim 4, wherein a tangential incidence of the plurality of outlet orifices is in the opposite direction to the direction of swirl of the spiral.

6. The combustion chamber as claimed in claim 1, wherein the outlet orifices and the inlet orifices are distributed in circular rows, the orifices of each row being evenly distributed over the periphery of the bowl.

7. The combustion chamber as claimed in claim 4, wherein an outer spiral is disposed between a downstream side of an annular cap and the divergent.

8. The combustion chamber as claimed in claim 7, wherein an inner spiral is disposed between an upstream side of the annular cap and the chamber bottom.

* * * * *